US010364095B2

(12) United States Patent
Utz

(10) Patent No.: US 10,364,095 B2
(45) Date of Patent: Jul. 30, 2019

(54) COLLAPSIBLE CONTAINER

(71) Applicant: Hans Utz, Decatur, GA (US)

(72) Inventor: Hans Utz, Decatur, GA (US)

( * ) Notice: Subject to any disclaimer, the term of this patent is extended or adjusted under 35 U.S.C. 154(b) by 250 days.

(21) Appl. No.: 15/333,632

(22) Filed: Oct. 25, 2016

(65) Prior Publication Data

US 2017/0129695 A1 May 11, 2017

Related U.S. Application Data

(60) Provisional application No. 62/253,481, filed on Nov. 10, 2015.

(51) Int. Cl.
*B65D 88/52* (2006.01)
*B65D 90/00* (2006.01)

(52) U.S. Cl.
CPC ..... *B65D 88/522* (2013.01); *B65D 88/524* (2013.01); *B65D 90/008* (2013.01)

(58) Field of Classification Search
CPC ... B65D 88/522; B65D 88/524; B65D 90/008
See application file for complete search history.

(56) References Cited

U.S. PATENT DOCUMENTS

| | | | |
|---|---|---|---|
| 3,527,339 | A | 9/1970 | Cipolla |
| 3,570,698 | A | 3/1971 | Dougherty |
| 3,612,330 | A | 10/1971 | Baer |
| 3,765,556 | A | 10/1973 | Baer |
| 3,840,135 | A | 10/1974 | Bridge |
| 3,966,285 | A | 6/1976 | Porch et al. |
| 4,019,634 | A | 4/1977 | Bonnot |
| 4,388,995 | A | 6/1983 | Ahn |
| 4,577,772 | A | 3/1986 | Bigliardi |
| 4,589,588 | A | 5/1986 | Swanhart |
| 4,618,068 | A | 10/1986 | Born |
| 4,684,034 | A | 8/1987 | Ono et al. |
| 4,779,751 | A | 10/1988 | Munroe |
| 4,848,618 | A | 7/1989 | Yuan et al. |
| 4,893,746 | A | 1/1990 | Swanhart |
| 4,966,085 | A | 10/1990 | Howe |
| 5,190,179 | A | 3/1993 | Richter et al. |
| 5,253,763 | A | 10/1993 | Kirkley et al. |
| 5,257,830 | A | 11/1993 | Pflueger |

(Continued)

FOREIGN PATENT DOCUMENTS

| | | | |
|---|---|---|---|
| EP | 0027350 | A1 | 4/1981 |
| FR | 9215632 | A1 | 6/1994 |
| WO | WO2011/154982 | A1 | 12/2011 |

OTHER PUBLICATIONS

Intellectual Property Office of Singapore, Examination Report, Application No. 11201802857Y, dated Sep. 21, 2018, Singapore.

(Continued)

*Primary Examiner* — Andrew T Kirsch
(74) *Attorney, Agent, or Firm* — Thomas B. McGurk

(57) ABSTRACT

A collapsible container is described in the present disclosure and can include a base, two end walls and two side walls, wherein each of the side walls include a plurality of movably connected panels that can be folded down to allow for the container to be collapsed into a more compact arrangement. The container also can include a roof that is movably connected to one or more of the walls to allow the walls to move relative to the roof.

18 Claims, 12 Drawing Sheets

(56) References Cited

U.S. PATENT DOCUMENTS

| | | | | |
|---|---|---|---|---|
| 5,275,301 | A | 1/1994 | Clive-Smith | |
| 5,289,933 | A | 3/1994 | Streich et al. | |
| 5,449,081 | A | 9/1995 | Sjostedt et al. | |
| 5,474,197 | A * | 12/1995 | Hillis | B65D 11/1833 220/1.5 |
| 5,501,353 | A | 3/1996 | Warren | |
| 5,735,423 | A | 4/1998 | Black | |
| 6,006,918 | A | 12/1999 | Hart | |
| 6,170,689 | B1 | 1/2001 | Flesher et al. | |
| 6,299,009 | B1 | 10/2001 | Ryziuk et al. | |
| 6,386,383 | B1 | 5/2002 | Roudonis | |
| 6,394,336 | B1 | 5/2002 | Beneroff et al. | |
| 6,454,148 | B1 | 9/2002 | Cook | |
| 6,811,048 | B2 | 11/2004 | Lau | |
| 6,820,761 | B1 | 11/2004 | Mouri et al. | |
| 7,243,674 | B2 | 7/2007 | Devine | |
| 7,296,704 | B2 | 11/2007 | Ferrini | |
| 7,353,962 | B2 | 4/2008 | Parnall et al. | |
| 7,823,739 | B2 | 11/2010 | Sadkin et al. | |
| 7,984,819 | B1 | 7/2011 | Davis | |
| 8,240,496 | B2 | 8/2012 | Kong et al. | |
| 8,342,347 | B2 | 1/2013 | Hay | |
| 8,342,784 | B2 | 1/2013 | Crane et al. | |
| 8,573,433 | B2 | 11/2013 | Kochanowski | |
| 2002/0084270 | A1 | 7/2002 | Metternich | |
| 2005/0017001 | A1 | 1/2005 | Katz | |
| 2006/0277836 | A1 | 12/2006 | Chazyn | |
| 2007/0007289 | A1* | 1/2007 | Hoberman | B65D 5/36 220/6 |
| 2007/0108204 | A1 | 5/2007 | Warhurst et al. | |
| 2008/0135545 | A1 | 6/2008 | Sadkin et al. | |
| 2011/0073595 | A1 | 3/2011 | Crane | |
| 2014/0183186 | A1 | 7/2014 | Buskermolen et al. | |

OTHER PUBLICATIONS

International Searching Authority/USA, International Search Report and Written Opinion, Application No. PCT/US2016/58637, dated Jan. 13, 2017, Alexandria, Virginia, USA.

Konings; Robert; "How to Boost Market Introduction of Foldable Containers? The Unexpected Role of Container Lease Industry"; European Transport/Trasporti Europei, n. 25-26; 2005; pp. 81-88; Instituto Trasporti dell'Universita degli Studi di Trieste; Trieste, Italy.

Konings; Rob and Remmelt; Thijs; "Foldable Containers: A New Perspective on Reducing Container-Repositioning Costs"; European Journal of Transport and Infrastructure Research; 2001; pp. 333-352; vol. 1, No. 4; Delft University of Technology; Delft, The Netherlands.

Konings; Rob; "Foldable Containers to Reduce the Costs of Empty Transport? A Cost-Benefit Analysis From a Chain and Multi-Actor Perspective"; Maritime Economics & Logistics; 2005; pp. 223-249; vol. 7; Palgrave Macmillan Ltd; London, United Kingdom.

Compact Container Systems; www.compactcontainers.com; 2009, 2012; pp. 1-5; Compact Container Systems; Boca, Raton, USA.

Cargoshell; Cargoshell website; www.cargoshell.com; pp. 1-2; Cargoshell; Rotterdam, The Netherlands.

Redactient; "Plastic Zeecontainer van Cargoshell gecertificeerd"; www.youtube.com/watch?v=B_WaGY1WILY; 2012; YouTube.

Staxxon Dynamic Container Systems; "Fold Nest Workflow"; www.staxxon.com/see-it-work/.

European Patent Office, Examination Report, Application No. EP16864762, dated Mar. 14, 2019, Munich, Germany.

* cited by examiner 100
102
104
106
108
112
122
124
126
128
130
132
150
152
154
156

COLLAPSIBLE CONTAINER

RELATED APPLICATION

This application claims the benefit of priority to U.S. Provisional Application No. 62/253,481, filed Nov. 10, 2015. The provisional application identified above is hereby incorporated by reference in its entirety herein to provide continuity of disclosure.

TECHNICAL FIELD

The present disclosure is directed to containers and, more particularly, containers that can be transitioned between an erect to a collapsed configuration.

BACKGROUND

Intermodal shipping containers are containers of standardized sizes used to ship cargo both regionally and internationally via road, rail, and water, and are widely employed with about twenty million such containers in use. Since they are typically made of rigid steel, they displace the same volume whether full or empty. Empty intermodal shipping containers make up a significant portion of containers being shipped at any one time. Whether being stored or transported, empty intermodal shipping containers pose handling and storage challenges due to their size and the space required to accommodate their full volumes.

Efforts to design collapsible intermodal shipping containers have led to containers that require more than one person to reconfigure between an erect and a collapsed configuration, and also require several minutes to effectuate the transition. Additional time and effort to handle such collapsible intermodal shipping containers make them ill suited for use in busy transport hubs and other streams of commerce.

Consequently, there is a need for a collapsible container that can better address these and other challenges.

SUMMARY

The present disclosure encompasses containers that have multi-section walls that can be folded to collapse the container and unfolded to extend the container. The present disclosure also encompasses various types of collapsible containers, including collapsible intermodal shipping containers.

The present disclosure encompasses a collapsible container comprising: a base; a first side wall movably connected to the base, wherein the first side wall comprises a bottom center trapezoidal panel movably connected to the base, a top center trapezoidal panel movably connected to the bottom trapezoidal panel, a first triangular panel movably connected to the top center trapezoidal panel, a second triangular panel movably connected to the top center trapezoidal panel, a first side trapezoidal panel movably connected to the bottom center trapezoidal panel and the first triangular panel, and a second side trapezoidal panel movably connected to the bottom center trapezoidal panel and the second triangular panel; a second side wall movably connected to the base and opposing the first side wall; a first end wall movably connected to the base, the first side wall and the second side wall; and, a second end wall movably connected to the base, the first side wall and the second side wall, and wherein the second end wall is opposed to the first end wall.

In another aspect, the collapsible container can further comprise a roof aligned over the base, wherein the roof movably cooperates with the first end wall, the second end wall, the first side wall and the second side wall. In a further aspect, the roof can comprise a rail, and wherein the first end wall further can comprise a first guide and the second end wall further comprises a second guide, and wherein the first guide and the second guide movably cooperate with the rail. In yet another aspect, the second side wall can comprise a second bottom center trapezoidal panel movably connected to the base, a second top center trapezoidal panel movably connected to the second bottom trapezoidal panel, a third triangular panel movably connected to the second top center trapezoidal panel, a fourth triangular panel movably connected to the second top center trapezoidal panel, a third side trapezoidal panel movably connected to the second bottom center trapezoidal panel and the third triangular panel, and a fourth side trapezoidal panel movably connected to the second bottom center trapezoidal panel and the fourth triangular panel. In still a further aspect, the first side wall further can comprise a plurality of external hinges mounted thereto. In another aspect, the first side wall further can comprise a plurality of internal hinges mounted thereto. In a further aspect, the bottom center trapezoidal panel can be movably connected to the base by an external hinge, and wherein the bottom center trapezoidal panel is movably connected to the top center trapezoidal panel by an internal hinge. In yet another aspect, the first triangular panel can be movably connected to the top center trapezoidal panel by an external hinge, and wherein the first triangular panel is movably connected to the first side trapezoidal panel by an internal hinge. In a further aspect, the second triangular panel can be movably connected to the top center trapezoidal panel by a second external hinge, and wherein the second triangular panel is movably connected to the second side trapezoidal panel by a second internal hinge. In still another aspect, the first side trapezoidal panel can be movably connected to the bottom center trapezoidal panel by a first internal hinge, and wherein the second side trapezoidal panel is movably connected to the bottom center trapezoidal panel by a second internal hinge. In a further aspect, the collapsible container can further comprise a roof aligned over the base, wherein the roof movably cooperates with the first end wall, the second end wall, the first side wall and the second side wall, wherein the roof comprises four corners, and wherein each of the four corners comprises a twistlock receiver disposed thereon, and wherein each twistlock receiver comprises a chamber, wherein at least a portion of a retainer is movably disposed within the chamber, and wherein the retainer movably cooperates with a twistlock inserted into the twistlock receiver. In still another aspect, the retainer can comprise a guide catch, wherein the guide catch movably engages a guide aligned adjacent a corner of the roof. In yet a further aspect, the guide catch can movably disengage the guide to collapse the container. In another aspect, the collapsible container further can comprise a door hingedly mounted to one of the first end wall and the second end wall.

The present disclosure also encompasses a collapsible intermodal shipping container comprising: a base; a first side wall movably connected to the base, wherein the first side wall comprises a first bottom center trapezoidal panel movably connected to the base, a first top center trapezoidal panel movably connected to the first bottom trapezoidal panel, a first triangular panel movably connected to the first top center trapezoidal panel, a second triangular panel movably connected to the first top center trapezoidal panel, a first side trapezoidal panel movably connected to the first bottom center trapezoidal panel and the first triangular panel, and a second side trapezoidal panel movably connected to the first bottom center trapezoidal panel and the second triangular panel; a second side wall movably connected to the base and opposing the first side wall, wherein the second side wall comprises a second bottom center trapezoidal panel movably connected to the base, a second top center trapezoidal panel movably connected to the second bottom trapezoidal panel, a third triangular panel movably connected to the second top center trapezoidal panel, a fourth triangular panel movably connected to the second top center trapezoidal panel, a third side trapezoidal panel movably connected to the second bottom center trapezoidal panel and the third triangular panel, and a fourth side trapezoidal panel movably connected to the second bottom center trapezoidal panel and the fourth triangular panel; a first end wall movably connected to the base, the first side wall and the second side wall; a second end wall movably connected to the base, the first side wall and the second side wall, wherein the second side wall is opposed to the first side wall; a roof aligned over the base, wherein the roof movably cooperates with the first end wall, the second end wall, the first side wall and the second side wall; and, a door mounted to one of the first end wall and the second end wall.

In another aspect, the roof can comprise a rail, and wherein the first end wall further comprises a first guide and the second end wall further comprises a second guide, wherein the first guide and the second guide movably cooperate with the rail, wherein the roof further comprises a second rail, and wherein the first end wall further comprises a third guide, and the second end wall further comprises a fourth guide, and wherein the third guide and the fourth guide movably cooperate with the second rail. In a further aspect, the collapsible intermodal shipping container can further comprise a twistlock receiver, wherein the twistlock receiver comprises a retainer, whereby the retainer movably cooperates with a twistlock inserted into the twistlock receiver, and wherein the retainer comprises a guide catch, wherein the guide catch movably engages at least one of the first guide, the second guide, the third guide and the fourth guide, and whereby the guide catch movably disengages the at least one of the first guide, the second guide, the third guide and the fourth guide to collapse the container.

The present disclosure further encompasses a collapsible intermodal shipping container comprising: a base; a first side wall movably connected to the base, wherein the first side wall comprises a first bottom center trapezoidal panel movably connected to the base by a first external hinge, a first top center trapezoidal panel movably connected to the first bottom trapezoidal panel by a first internal hinge, a first triangular panel movably connected to the first top center trapezoidal panel by a second external hinge, a second triangular panel movably connected to the first top center trapezoidal panel by a third external hinge, a first side trapezoidal panel movably connected to the first bottom center trapezoidal panel by a second internal hinge, wherein the first side trapezoidal panel is movably connected to the first triangular panel by a third internal hinge, and a second side trapezoidal panel movably connected to the first bottom center trapezoidal panel by a fourth internal hinge, and wherein the second side trapezoidal panel is movably connected to the second triangular panel by a fifth internal hinge; a second side wall movably connected to the base and opposing the first side wall, wherein the second side wall comprises a second bottom center trapezoidal panel movably connected to the base by a fourth external hinge, a second top center trapezoidal panel movably connected to the second bottom trapezoidal panel by a sixth internal hinge, a third triangular panel movably connected to the second top center trapezoidal panel by a fifth external hinge, a fourth triangular panel movably connected to the second top center trapezoidal panel by a sixth external hinge, a third side trapezoidal panel movably connected to the second bottom center trapezoidal panel by a seventh internal hinge, wherein the third side trapezoidal panel is movably connected to the third triangular panel by an eighth internal hinge, and a fourth side trapezoidal panel movably connected to the second bottom center trapezoidal panel by a ninth internal hinge, and wherein the fourth side trapezoidal panel is movably connected to the fourth triangular panel by a tenth internal hinge; a first end wall movably connected to the base by a seventh external hinge, wherein the first end wall is movably connected to the first side wall by an eighth external hinge, and wherein the first end wall is movably connected to the second side wall by a ninth external hinge; a second end wall movably connected to the base by a tenth external hinge, wherein the second end wall is movably connected to the first side wall by an eleventh external hinge, wherein the second end wall is movably connected to the second side wall by a twelfth external hinge, and wherein the second side wall is opposed to the first side wall; a roof aligned over the base, wherein the roof movably cooperates with the first end wall, the second end wall, the first side wall and the second side wall, wherein the roof comprises a rail, and wherein the first end wall further comprises a first guide and the second end wall further comprises a second guide, wherein the first guide and the second guide movably cooperate with the rail; a twistlock receiver mounted to the roof, wherein the twistlock receiver comprises a retainer, whereby the retainer movably cooperates with a twistlock inserted into the twistlock receiver, and wherein the retainer comprises a guide catch, wherein the guide catch movably engages at least one of the first guide and the second guide, and whereby the guide catch movably disengages the at least one of the first guide and the second guide to collapse the container; and, a door hingedly mounted to one of the first end wall and the second end wall.

In another aspect, the present disclosure encompasses a collapsible container as described herein and wherein the container is an intermodal shipping container. In a further aspect, the collapsible container can further comprise a door formed in one of the first and the second end walls thereof. In yet another aspect, the first and second end walls and the first and second side walls can be formed of steel.

These and other aspects of the present disclosure are set forth in more detail below and illustrated in the drawings, which are briefly described as follows.

DETAILED DESCRIPTION

The present disclosure is directed to collapsible containers that include movable side and end walls that can be reconfigured from a fully erect arrangement to a collapsed arrangement so as to allow the volume of the collapsible container to be reduced. The collapsible containers encompassed by the present disclosure include side walls that are formed of a plurality of movable panels that can be folded to collapse the container and unfolded to erect the container. The collapsible containers encompassed by the present disclosure can include any type of container for which the disclosed features are suitable including, but not limited to, storage containers, product boxes, delivery boxes, intermodal shipping containers, and temporary storage buildings. The collapsible containers encompassed by the present disclosure can be formed of any suitable material, such as, for example a metal, such as steel plate or corrugated metal, plastic, cardboard, wood, particle board or other materials known in the art for use as a material of construction for a container.

As used herein, the singular forms of "a," "an," and "the" encompasses the plural form thereof unless otherwise indicated. As used herein, the phrase "at least one" includes all numbers of one and greater. As used herein, the term "and/or" refers to one or all of the listed elements or a combination of any two or more of the listed elements. As used herein, the term "movably connected" refers to the relationship between two or more components whereby one or both components are movable relative to each other while remaining connected to each other. As used herein, the term "movably cooperate" refers to the relationship between two or more components whereby one or both components move while interacting with each other or with one or more other components to carry out a function. As used herein, the term "hingedly connected" refers to the relationship between two or more components whereby the two or more components are connected, either directly or indirectly, by one or more hinges and whereby at least one of the two or more components move via movement of the hinge.

Figure 1:
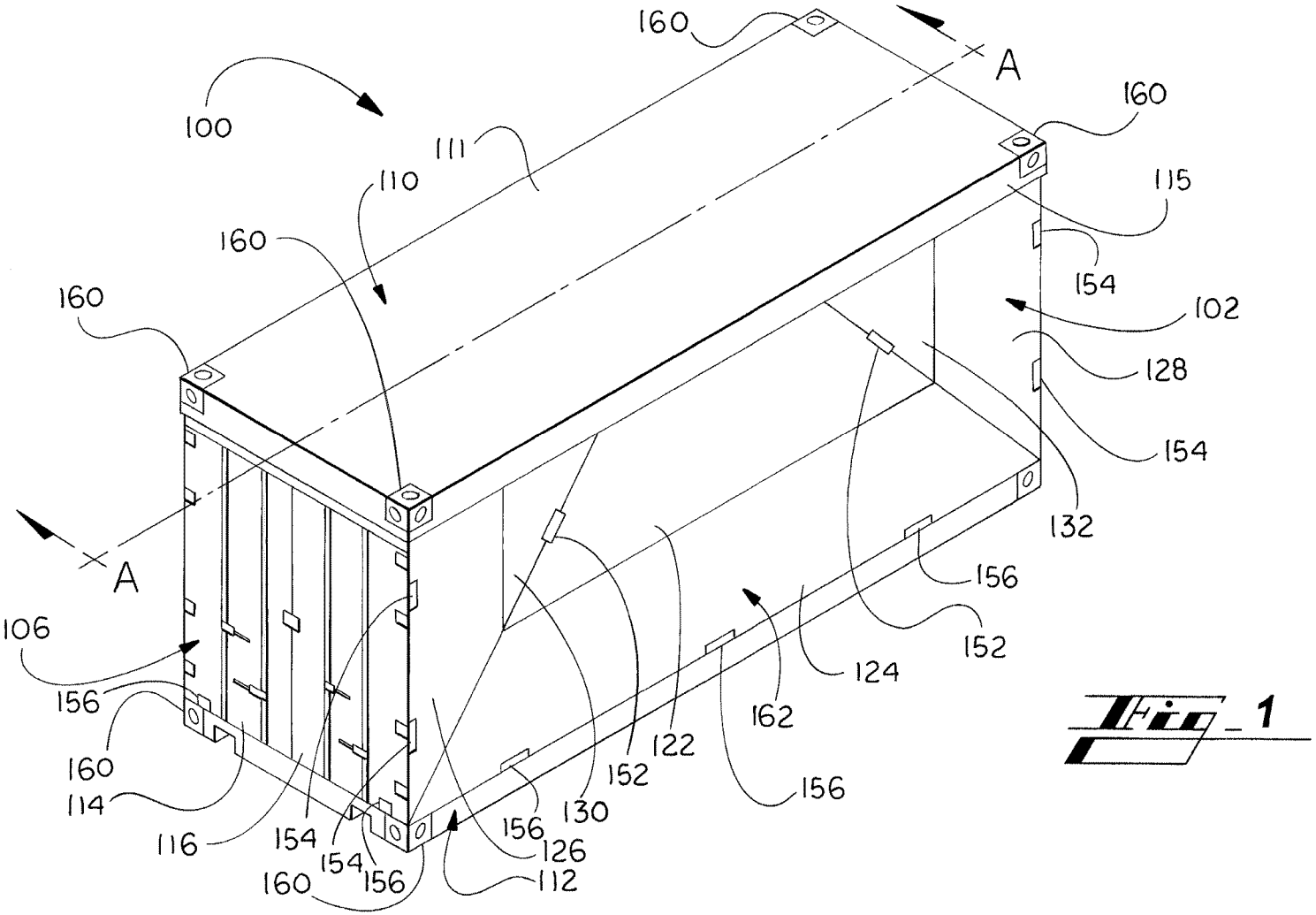
FIG. 1 illustrates a perspective view of a collapsible container encompassing aspects of the present disclosure.

FIGS. 1-14 illustrate various aspects of a collapsible container 100 that is illustrated as an intermodal shipping container. The collapsible container 100 is shown comprising a base 112 to which is movably connected a first side wall 102, an opposing second side wall 104, a first end wall 106, an opposing second end wall 108, a roof 110 disposed above the walls and aligned over a base 112. As shown in FIG. 1, the collapsible container 100, when erect, is generally a rectangular prism in arrangement with the first side wall 102 and the second side wall 104 disposed along the major sides of the rectangular prism and longer than the first end wall 106 and the second end wall 108, which are disposed along the minor sides of the prism. The roof 110 is aligned above the base 112, both when the collapsible container is in an erect and in a collapsed position. At least a portion of the roof 110 is aligned generally parallel to the base 112 when the collapsible container 100 is in an erect position and is of similar shape and size to the base 112. The first and the second side walls 102 and 104 and the first and second end walls 106 and 108 are movably connected to the base 112 by a plurality of bottom edge external hinges 156. Each of the first and the second side walls 102 and 104 is likewise connected to the opposed first and second end walls 106 and 108, respectively, by one or more corner external hinges 154.

The roof 110 includes a top panel 111 that extends over the area of the base 112, the first and the second end walls 106 and 108, and the first and the second side walls 102 and 104. A skirt 115 depends from the top panel 111 of the roof 110 and extends around the perimeter of the top panel 111 so that one of the sections of the skirt 115 is adjacent each of the first side wall 102, the second side wall 104, the first end wall 106, and the second end wall 108, when the container 100 is in an erect alignment, as shown in FIG. 1. When the container 100 is in an erect alignment, the top edge of each of the first and the second end walls 106 and 108 and the first and the second side walls 102 and 104 is disposed below the top panel 11 and either below or interior to the skirt 115. If the container 100 is configured so that the second end walls 106 and 108 and the first and the second side walls 102 and 104 are interior to the skirt 115, then the skirt 115 extends down a portion of the height of each of the first and the second side walls 102 and 104 and the first and the second end walls 106 and 108. Extending along the interior portion of the two major sides of the skirt 115 are disposed a first rail 118 and a second rail 120. Each of the first and the second rails 118 and 120 are configured to receive at least a portion of one or more guides connected to the first and the second end walls 106 and 108 and to cooperate with such portions of the one or more guides to allow the container to be raised and collapsed with the roof 115 remaining in proximity to the walls.

Figure 4:
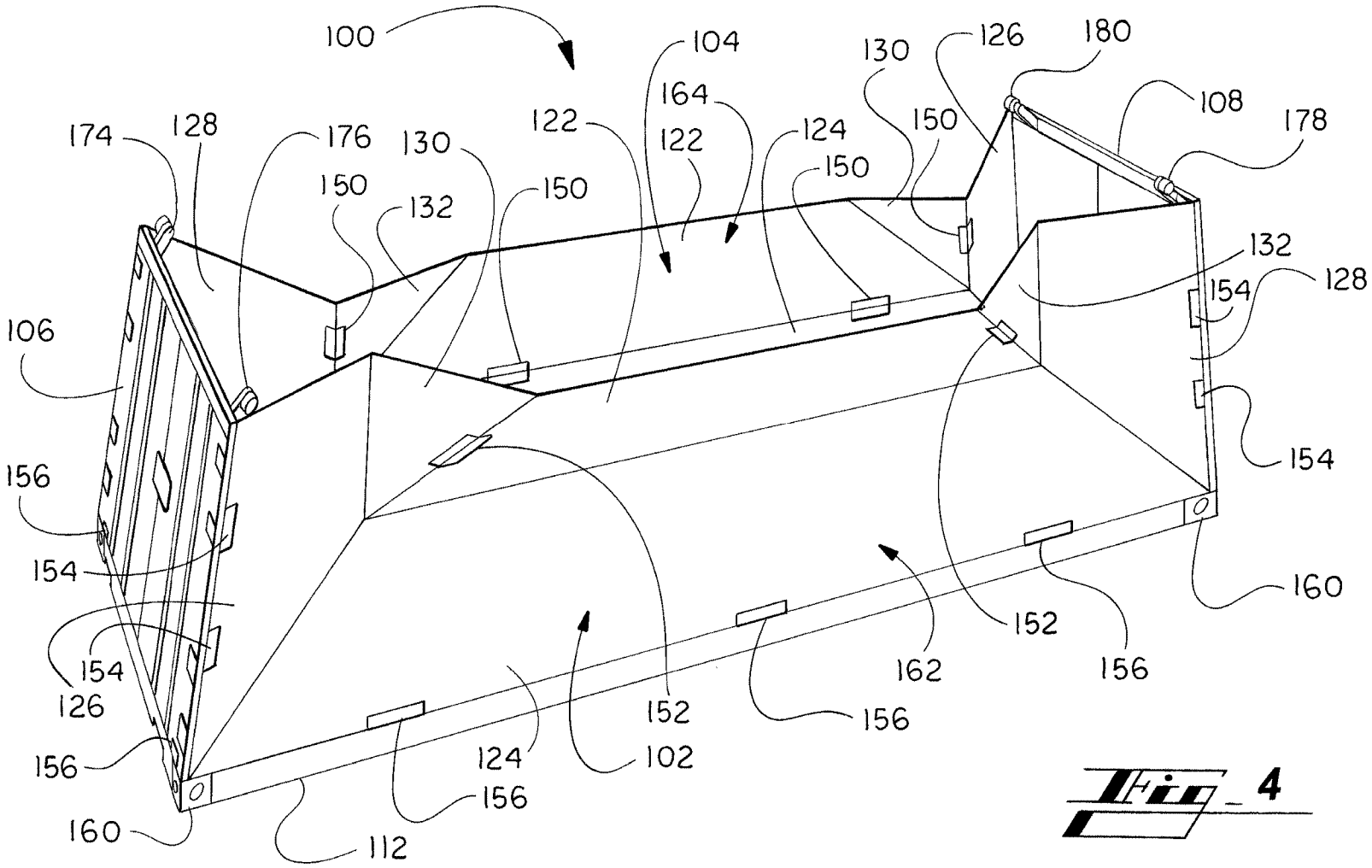
FIG. 4 illustrates a perspective view of the collapsible container of FIG. 1 with the roof removed and the container in a partially collapsed state.
Figure 5:
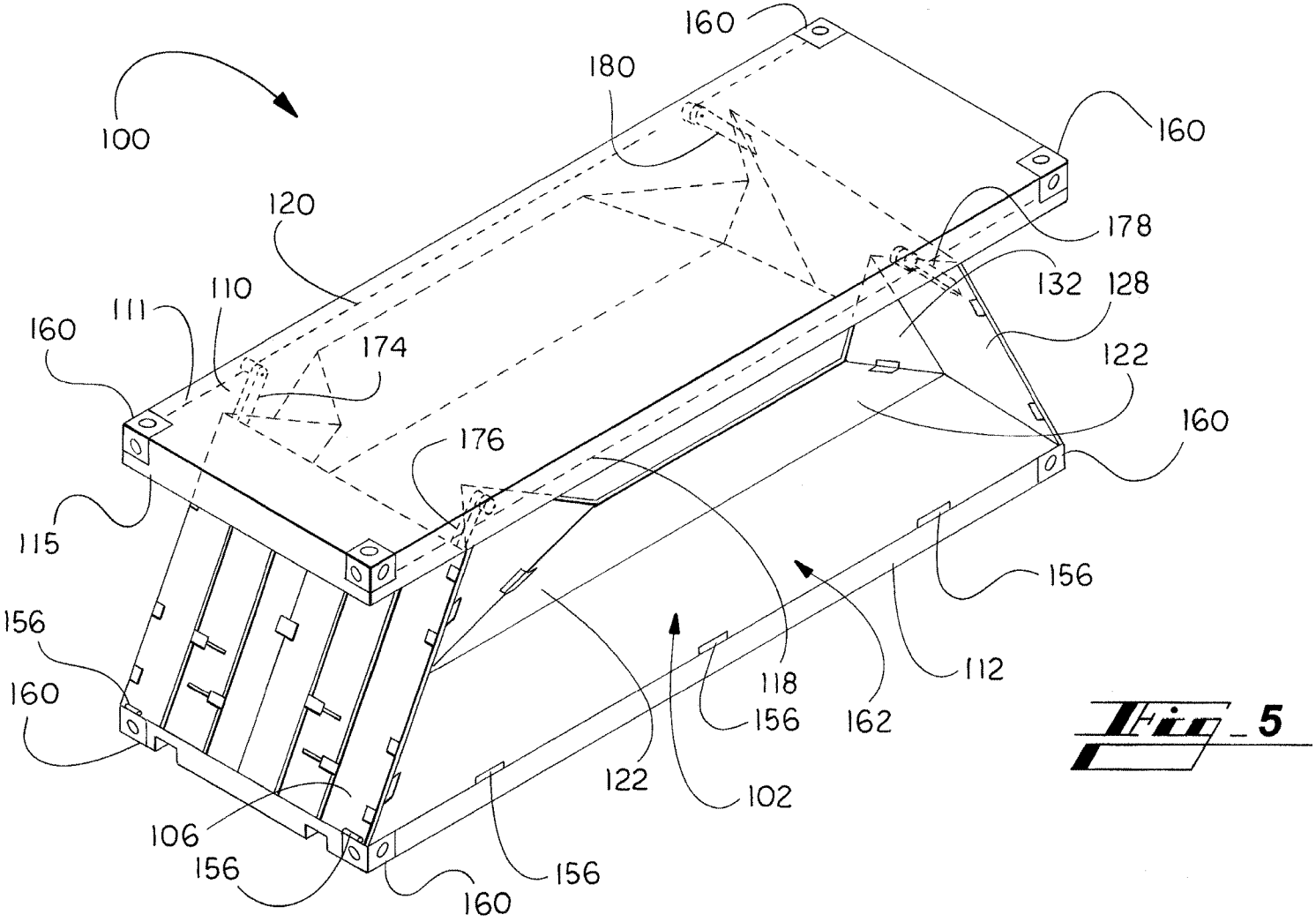
FIG. 5 illustrates a perspective view of the collapsible container of FIG. 1 in a partially collapsed state with portions of the container otherwise obscured by the roof shown in dashed line.
Figure 6:
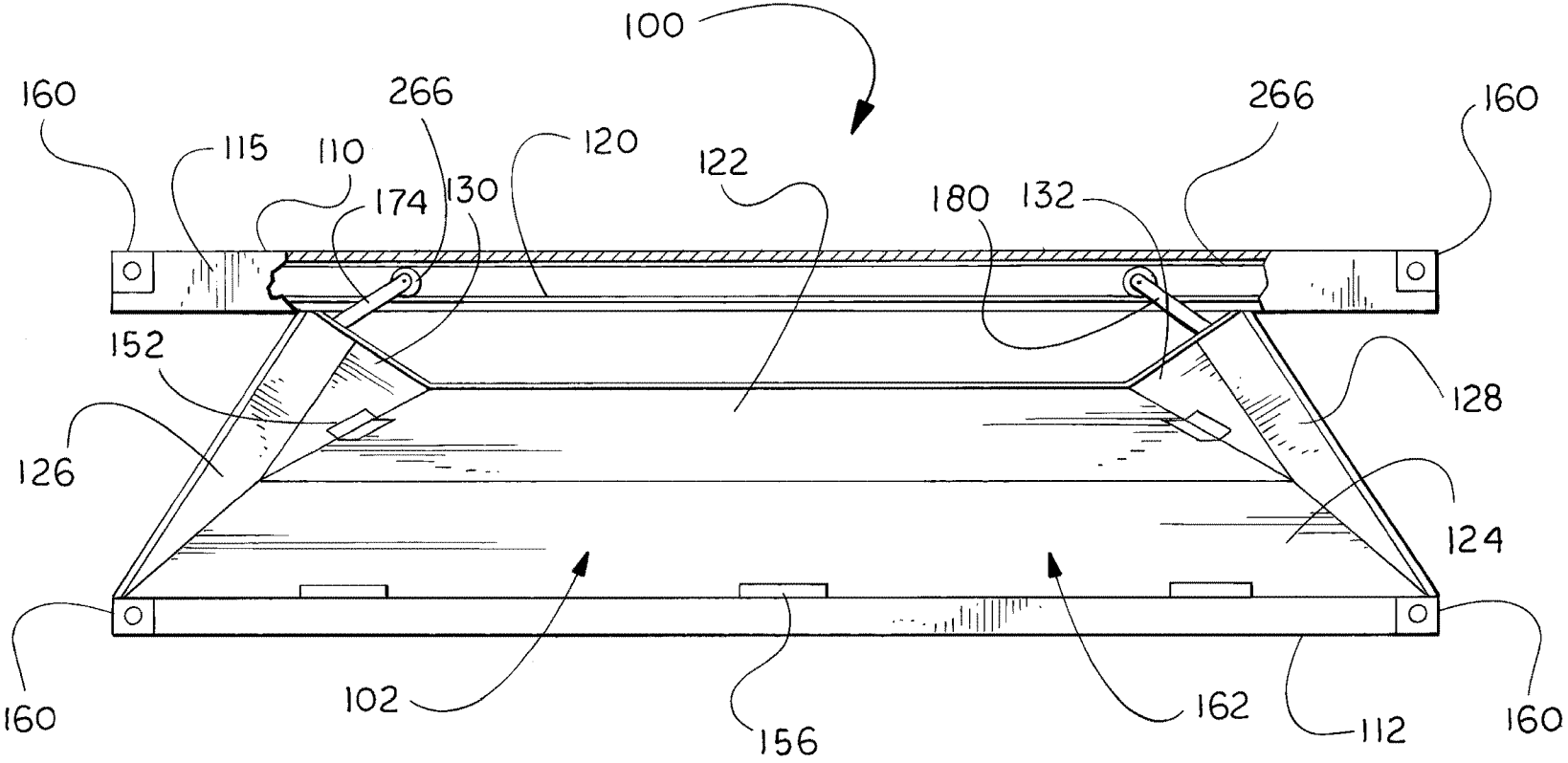
FIG. 6 illustrates a side elevation view of the collapsible container of FIG. 1 in a partially collapsed state and with the skirt of the roof cutaway to show a portion of one of the rails.

As shown in FIG. 4, connected to the first end wall 106 is a first guide 176 extending from the top right corner thereof and a second guide 174 extending from the top left corner thereof, as viewed from the exterior side of the first end wall 106. The first guide 176 is aligned to move and to engage the first rail 118, and the second guide 174 is aligned to movably engage the second rail 120. The first guide 176 and the second guide 174 with the first rail 118 and the second rail 120, respectively, to maintain the relative alignment of the roof 110 with the first end wall 106 as both the roof 110 and the first end wall 106 move between erect and collapsed alignments. The second end wall 108 includes a third guide 178 extending from the top left corner of the second side wall 108 and a fourth guide 180 extending from the top right corner of the second side wall 108 as viewed from the exterior side of the second end wall 108. The third guide 178 is aligned to move and to engage the first rail 118 and the fourth guide 180 is aligned to movably engage the second rail 120. The third guide 178 and the fourth guide 180 likewise also movably cooperate with the first rail 118 and the second rail 120, respectively, to maintain the relative alignment of the roof 110 with the second end wall 108 as both the roof 110 and the second end wall 108 move between erect and collapsed alignments. One or more of the first guide 176, the second guide 174, the third guide 178, and the fourth guide 180 can take the form of an arm, pin, roller or other suitable structure that can be at least partially aligned within the respective first rail 118 and the second rail 120 so as to move along at least a portion of the length of the respective rail, while maintaining alignment with the respective rail.

Figure 2A:
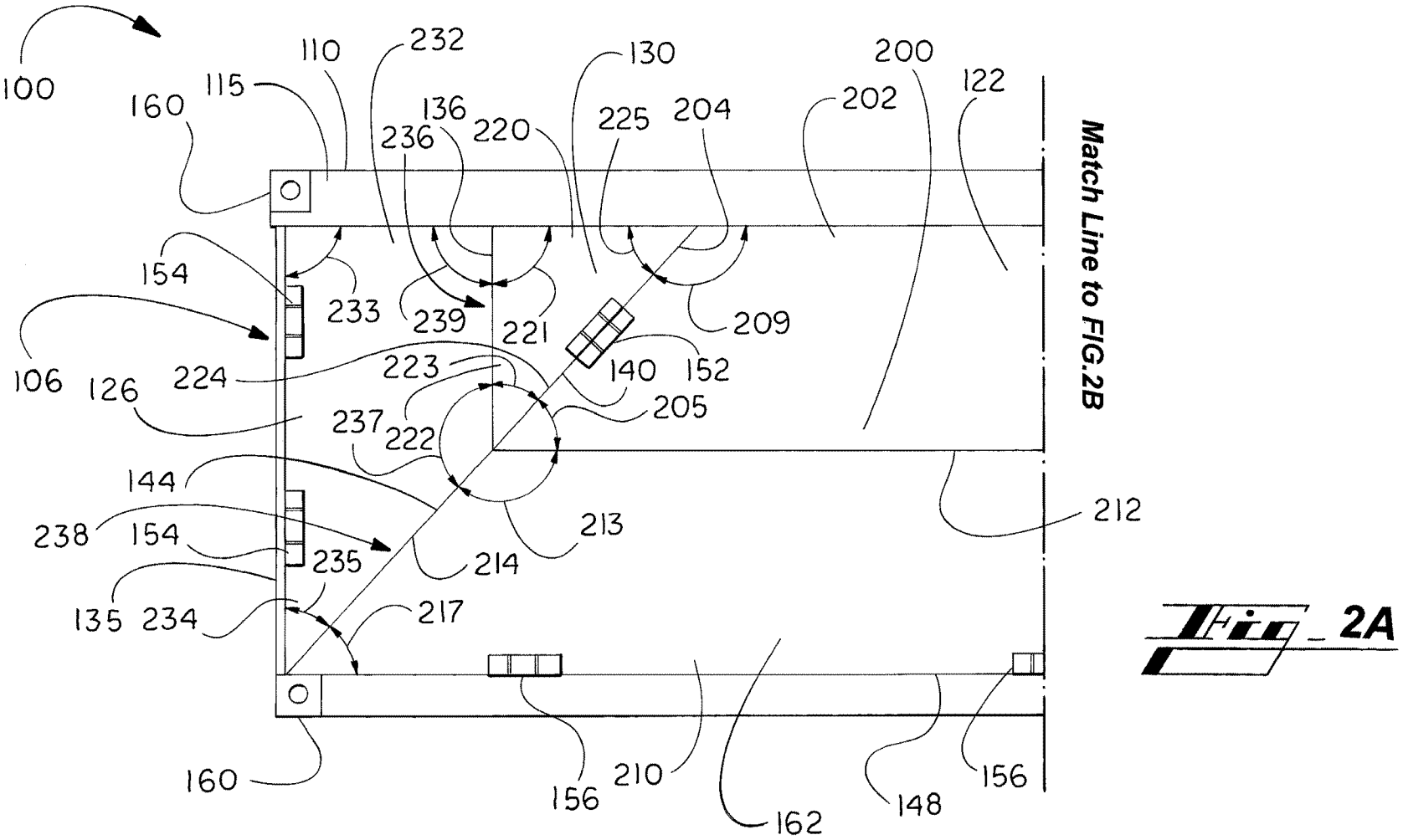
FIG. 2A illustrates a side elevation view of the left half of the collapsible container of FIG. 1.
Figure 2B:
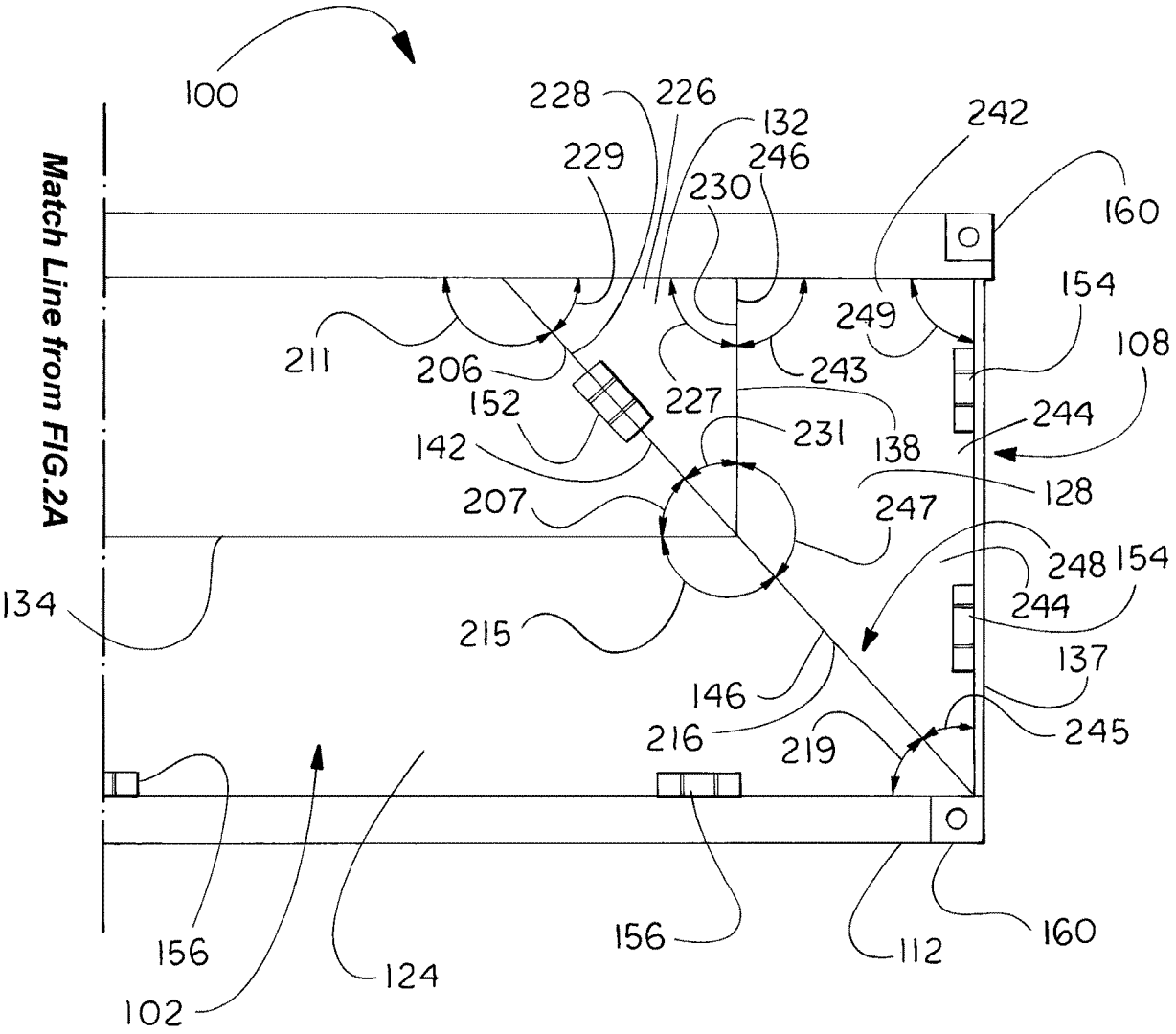
FIG. 2B illustrates a side elevation view of the right half of the collapsible container of FIG. 1.
Figure 3:
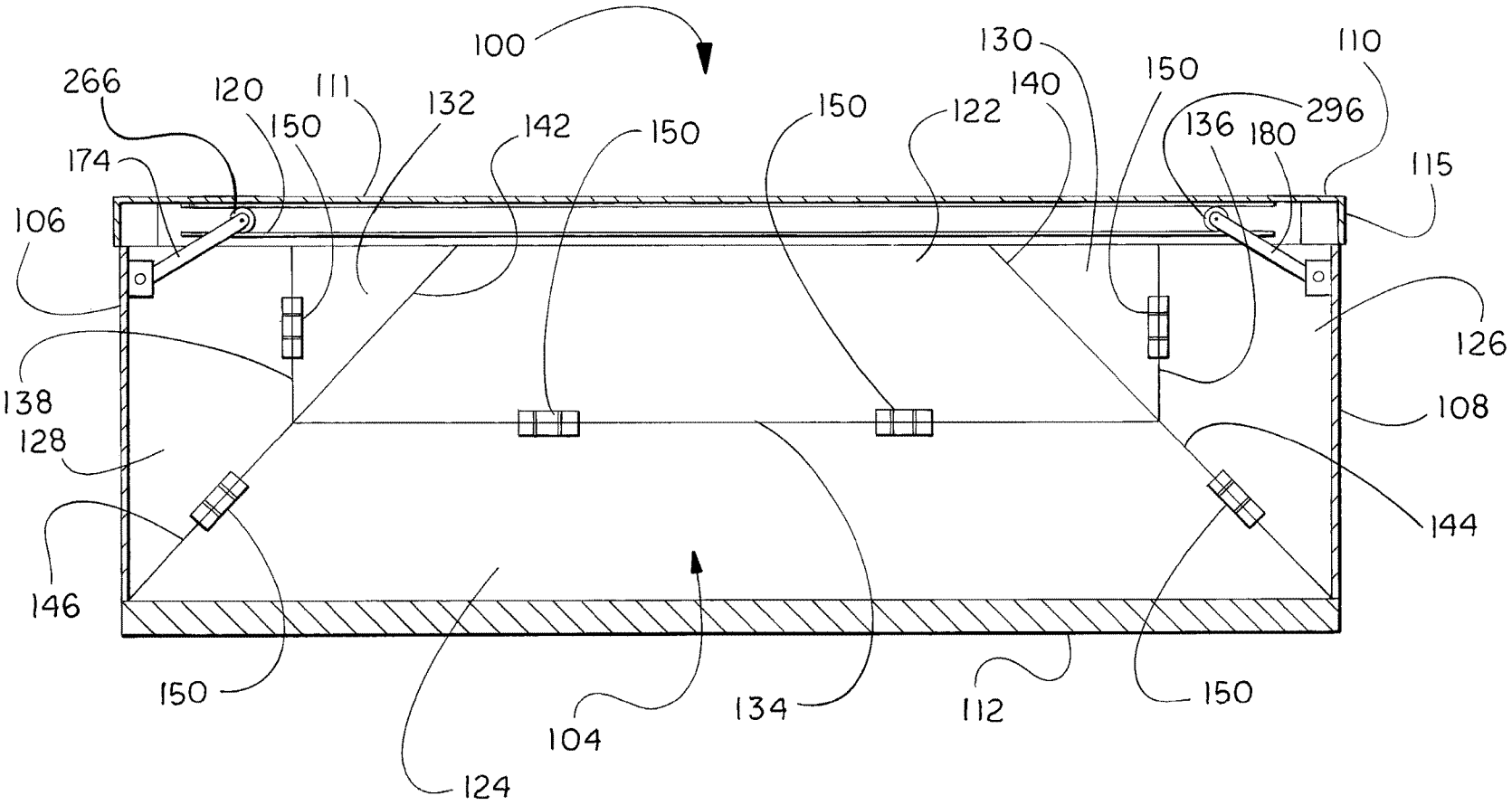
FIG. 3 illustrates a cross-section view of the collapsible container of FIG. 1 taken along lines A-A with portions of the guides removed.

As shown in FIGS. 2A, 2B and 3, each of the first side wall 102 and the second side wall 104 includes a plurality of movable panels that cooperate to form the first side wall 102 and the second side wall 104 when erect and can fold down and partially overlap each other when the container 100 is collapsed. The first and the second side walls 102 and 104 are identically formed with the same number and configuration of panels and hinges so that for each side wall the respective panels and hinges are named and numbered identically in the present disclosure. Each of the plurality of panels is movably connected to the adjacent panels to allow the panels to fold down upon each other in order to allow the first and the second side walls 102 and 104 to collapse. Each of the first side wall 102 and the second side wall 104 includes a plurality of external hinges 152 disposed on the exterior face 162 of the respective first side wall 102 and the second side wall 104, and a plurality of internal hinges 150 disposed on the interior face 164 of the respective side wall along some of the joints formed between the panels. The external hinges 152 are disposed between and connect some of the adjacent panels to allow those panels to fold outward along the joint, while the internal hinges 150 allow the connected panels to fold inward along the joint.

More particularly, each of the first side wall 102 and the second side wall 104 includes a pair of centrally aligned trapezoidal panels, a top center trapezoidal panel 122 and a bottom center trapezoidal panel 124. The top center trapezoidal panel 122 includes four sides—a top side 202, a base side 200, a left side 204 and a right side 206. The top side 202 can define a portion of the top side of the first side wall 102 and is aligned parallel to the base side 200. The base side 200 is longer than the top side 202, the left side 204 and the right side 206. The left side 204 is not parallel to the right side 206. The left side 204 and the base side 200 cooperate to form a first acute angle 205 that is less than 90°. The right side 206 and the base side 200 cooperate to form a second acute angle 207 that is less than 90°. The left side 204 and the right side 206 can be the same length and less than the lengths of both the base side 200 and the top side 202. The top side 202 and the left side 204 cooperate to form a first obtuse angle 209 that is greater than 90°, and the top side 202 and the right side 206 cooperate to form a second obtuse angle 211 that is greater than 90°.

The bottom trapezoidal panel 124 includes four sides—a base side 210, a top side 212, a left side 214 and a right side 216. The top side 212 is parallel to the bottom side 210 and has a length less than the length of the base side 210. The base side 210 can define a portion of the base side of the respective first or second side wall 102 or 104. The left side 214 is not parallel to the right side 216, but is the same length as the right side 216. The lengths of the left side 214 and the right side 216 are less than the lengths of the top side 212 and the base side 210. The left side 214 and the top side 212 cooperate to form a first obtuse angle 213 that is greater than 90°, and the top side 212 and the right side 216 cooperate to form a second obtuse angle 215, that is greater than 90°. The left side 214 and the base side 210 cooperate to form a first acute angle 217 that is less than 90°, and the base side 210 and the right side 216 cooperate to form a second acute angle 219, that is less than 90°.

The first acute angle 217 of the bottom center trapezoidal panel 124 is equal to the first acute angle 205 of the top center trapezoidal panel 122, and the second acute angle 219 of the bottom center trapezoidal panel 124 is equal to the second acute angle 207 of the first center trapezoidal panel 122. All of the acute angles 205, 207, 217, and 219 can be equal to each other. Furthermore, the first obtuse angle 209 of the first center trapezoidal panel 122 can be equal to the first obtuse angle 213 of the bottom center trapezoidal panel 124, and the second obtuse angle 207 of the top center trapezoidal panel 122 can be equal to the second obtuse angle 215 of the bottom center trapezoidal panel 124. All of the obtuse angles 209, 211, 213 and 215 can be equal to each other. Furthermore, the top side 212 of the bottom center trapezoidal panel 124 can be adjacent to and the same length as the base side 200 of the top center trapezoidal panel 122. Also, the left side 204 of the top center trapezoidal panel 122 is collinear with the left side 214 of the bottom center trapezoidal panel 124 when the respective first or second side walls 102 or 104 are in an erect configuration. Likewise, the right side 206 of the top center trapezoidal panel 122 is collinear with the right side 216 of the bottom center trapezoidal panel 124 when the respective side wall is in an erect configuration.

In one aspect, the height of the top center trapezoidal panel 122 can be equal to the height of the bottom center trapezoidal panel 124. Alternatively, the height of the top center trapezoidal panel 122 can be less than the height of the bottom center trapezoidal panel 124. The top center trapezoidal panel 122 is aligned adjacent to and abuts the bottom center trapezoidal panel 124 along horizontal joint 134, which extends a majority of the length of respective first or second side wall 102 or 104 and is aligned equidistant from the top edge and the bottom edge of the respective first or second side wall 102 or 104 when the side wall is in an erect configuration. Two internal hinges 150 are aligned along the horizontal joint 134 and movably connect the top center trapezoidal panel 122 to the bottom center trapezoidal panel 124. Both the top and bottom center trapezoidal panels 122 and 124 are in the form of isosceles trapezoids with congruent left and right sides and congruent angles.

The first triangular panel 130 includes a top side 220, a left side 222 and a right side 224. The top side 220 is collinear with the top side 202 of the top center trapezoidal panel 122 and forms part of the top side of the first side wall 102 when the side wall is in an erect configuration. The top side 220 is the same length as the left side 222 and cooperates therewith to form a right angle 221. The left side 222 is aligned perpendicular to the top edge 220 and forms an acute angle 223 with the right side 224. The right side 224 forms the hypotenuse of the first triangular panel 130 and is adjacent to the left side 204 of the top center trapezoidal panel 122, thereby forming a top left diagonal joint 140. The right side 224 cooperates with the top edge 220 to form an acute angle 225 that is equal to or congruent with the acute angle 223 and is equal to 45°.

The second triangular panel 132 includes a top side 226, a left side 228 and a right side 230. The top side 226 is collinear with the top side 202 of the top center trapezoidal panel 122 and forms part of the top side of the respective first or second side wall 102 or 104 when the container 100 is fully erect. The top side 226 is the same length as the right side 230 and cooperates therewith to form a right angle 227. The right side 230 is aligned perpendicular to the top edge 220 and forms an acute angle 231 with the left side 228. The left side 228 forms the hypotenuse of the second triangular panel 132 and is adjacent to the right side 206 of the top center trapezoidal panel 122 and forms a top right diagonal joint 142. The left side 228 cooperates with the top edge 226 to form an acute angle 229 that is equal to or congruent with the acute angle 231 and is equal to 45°. The first and the second triangular panels 130 and 132 have the form of right isosceles triangles with congruent legs and are congruent to each other.

The first side trapezoidal panel 126 has four sides—top side 232, left side 234, right side 236, and base side 238. The top side 232 is collinear with the top edge 220 of the first triangular panel 130 and forms part of the top side of the first side wall 102 when the container 100 is erect. The left side 234 is perpendicular to and cooperates with the top side 232 to form a first right angle 233 and extends from the top side of the respective side wall to the base thereof. In the case of the first side wall 102, the left side 234 of the first side trapezoidal panel 126 is aligned adjacent with and movably connected to the first end wall 106 by one or more corner external hinges 154. In the case of the second side wall 104, the left side 234 of the first trapezoidal panel 126 is aligned adjacent with and movably connected to the second end wall 108 by one or more corner external hinges 154. The base side 238 cooperates with the left side 234 to form an acute angle 235. The base side 238 is aligned adjacent to and has the same length as the left side 214 of the bottom center trapezoidal panel 124 and forms a bottom left diagonal joint 144 that has an inward fold and is connected by an internal hinge 150. The base side 238 cooperates with the right side 236 to form an obtuse angle 237. The right side 236 is parallel to the left side 234 of the first side trapezoidal panel 126. The right side 236 is aligned adjacent to and is the same length as the left side 222 of the first triangular panel 130 and forms a left vertical joint 136 that folds inward and is connected by an internal hinge 150. The right side 236 cooperates with the top side 232 to form a second right angle 239.

The second side trapezoidal panel 128 also has four sides—top side 242, left side 246, right side 244, and base side 248. The top side 242 is collinear with the top edge 226 of the second triangular panel 132 and forms part of the top side of the first side wall 102 when the respective first or second side wall 102 or 104 is erect. The right side 244 is perpendicular to and cooperates with the top side 242 to form a first right angle 249 and extends from the top side of the respective first or second side wall 102 or 104 to the base thereof. In the case of the first side wall 102, the right side 234 is aligned adjacent with and movably connected to the second end wall 108 by one or more corner external hinges 154. In the case of the second side wall 104, the right side 234 is aligned adjacent with and movably connected to the first end wall 106 by one or more corner external hinges 154. The base side 248 cooperates with the right side 244 to form an acute angle 245. The base side 248 is aligned adjacent to and has the same length as the right side 216 of the bottom center trapezoidal panel 124 and forms a bottom right diagonal joint 146 that folds inward and is connected by an internal hinge 150. The base side 248 cooperates with the left side 246 to form an obtuse angle 247. The left side 246 is parallel to the right side 244 of the second side trapezoidal panel 128. The left side 246 is aligned adjacent to and is the same length as the right side 230 of the second triangular panel 132 and forms a right vertical joint 138 that folds inward and is connected by an internal hinge 150. The left side 246 cooperates with the top side 242 to form a second right angle 249. The left and second side trapezoidal panels 126 and 128 are congruent with each other.

Each of the first and the second side walls 102 and 104 includes a plurality of joints formed in the span thereof to allow the panel to extend and collapse as needed. The horizontal joint 134 is disposed between the base side 200 of the top center trapezoidal panel 122 and the top side 212 of the bottom center trapezoidal panel 124. The left vertical joint 136 is disposed between the right side 236 of the first side trapezoidal panel 126 and the left side 222 of the first triangular panel 130. The right vertical joint 138 is disposed between the left side 246 of the second side trapezoidal panel 128 and the right side 230 of the second triangular panel 132. The top left diagonal joint 140 is disposed between the right side 224 of the first triangular panel 130 and the left side 204 of the top center trapezoidal panel 122. The bottom left diagonal joint 144 is collinear with the top left diagonal joint 140 and is disposed between the base side 238 of the first side trapezoidal panel 126 and the left side 214 of the bottom center trapezoidal panel 124. The top right diagonal joint 142 is disposed between the right side 206 of the top center trapezoidal panel 122 and the left side 228 of the second triangular panel 132. The bottom right diagonal joint 146 is collinear with the top right diagonal joint 142 and is disposed between the right side 216 of the bottom trapezoidal panel 124 and the base side 248 of the second side trapezoidal panel 128. A strip of material suitable for partially or completely sealing the joints when the container 100 is erect can be disposed along one or both adjacent panels in each joint. Such strips can be formed of polymeric material.

The container 100 includes a plurality of internal hinges 150 and a plurality of external hinges 152, 154 and 156. The internal hinges 150 are configured such that, when folded, an internal hinge 150 is interior to the two panels to which the internal hinge 150 is affixed, and with the ending folding position of the internal hinge 150 being proximate to the interior of the container 100. The external hinges 152, 154 and 156 are configured such that, when folded, an external hinge 152, 154 and 156 is exterior to the two panels to which the external hinge 152 is affixed, and with the ending folding position of the external hinge 152, 154 and 156 being distal to the interior of the container 100. A plurality of internal hinges 150 are aligned along some of the joints on the interior faces 164 of the side walls 102 and 104 and a plurality of external hinges 152, 154 and 156 are aligned along other joints on the exterior faces 162 of the side walls 102 and 104. More particularly, one or more internal hinges 150 are disposed along each of the horizontal joint 134, the left vertical joint 136, the right vertical joint 138, the bottom left diagonal joint 144 and the bottom right diagonal joint 146. The internal hinges 150 are operably connected to the panels adjacent to and forming each joint, thereby allowing the adjacent panels to fold relative to each other as the respective first or second side wall 102 or 104 is collapsed. At each of the indicated joints 134, 136, 138, 144 and 146, the panels fold inward as the respective side wall collapses, with the internal hinges 150 allowing the folding to occur and maintain the connection between the adjacent panels. External hinges 152 are disposed along each of the top left diagonal joint 140 and the top right diagonal joint 142, thereby allowing the top center trapezoidal panel 122 to fold down and outward as the respective first or second side wall 102 or 104 moves from a fully erect to a collapsed alignment. Corner external hinges 154 are disposed along the left side wall edge joint 135, the right side wall joint 137, thereby movably connecting the respective first or second side wall 102 or 104 to the first end wall 106, the second end wall 108, respectively. The corner external hinges 154 are disposed along joints 135 and 137 so as to allow the first and the second side trapezoidal panels 126 and 128 to swing inward toward the respective end walls 106 and 108. The bottom edge external hinges 156 disposed along the base joints 148 of the first side wall 102 and the second side wall 104 and allow the bottom center trapezoidal panels 124 to swing inward and down toward the base 112.

As shown in FIGS. 4-8, when the container 100 is collapsed, the bottom center trapezoidal panel 124 folds inwardly and down toward the base 112 with the base side 210 aligned adjacent the outer edge of the base 112 and the top side 212 aligned along an interior portion of the base 112. Also, the top center trapezoidal panel 122 folds outwardly and down to collapse on top of the bottom trapezoidal panel 124 with the top side 202 aligned adjacent the base side 210 of the bottom center trapezoidal panel 124 and the base side 200 aligned adjacent the top side 212 along the interior of the base 112. The first and second triangular panels 130 and 132 fold down on top of the top center trapezoidal panel 122 with the left side 222 of the first triangular panel 130 and the right side 230 of the second triangular panel 132 aligned over the base side 200 of the top center trapezoidal panel 122 and the top side 212 of the bottom center trapezoidal panel 124 along the interior of the base 112. The right side 224 of the first triangular panel 130 and the left side 228 of the second triangular panel 132 fold downward over and are aligned along intermediate portions of the top center trapezoidal panel 122 and are perpendicular to the top side 202 of the top center trapezoidal panel 122 with each of the left and second triangular panels 130 and 132 folding down onto the top center trapezoidal panel 122. The first and the second side trapezoidal panels 126 and 128 fold inwardly along the left and right side wall edge joints 135 and 137, respectively, so that they fold down over the first and second triangular panels 130 and 132, respectively.

Figures 7, 8:
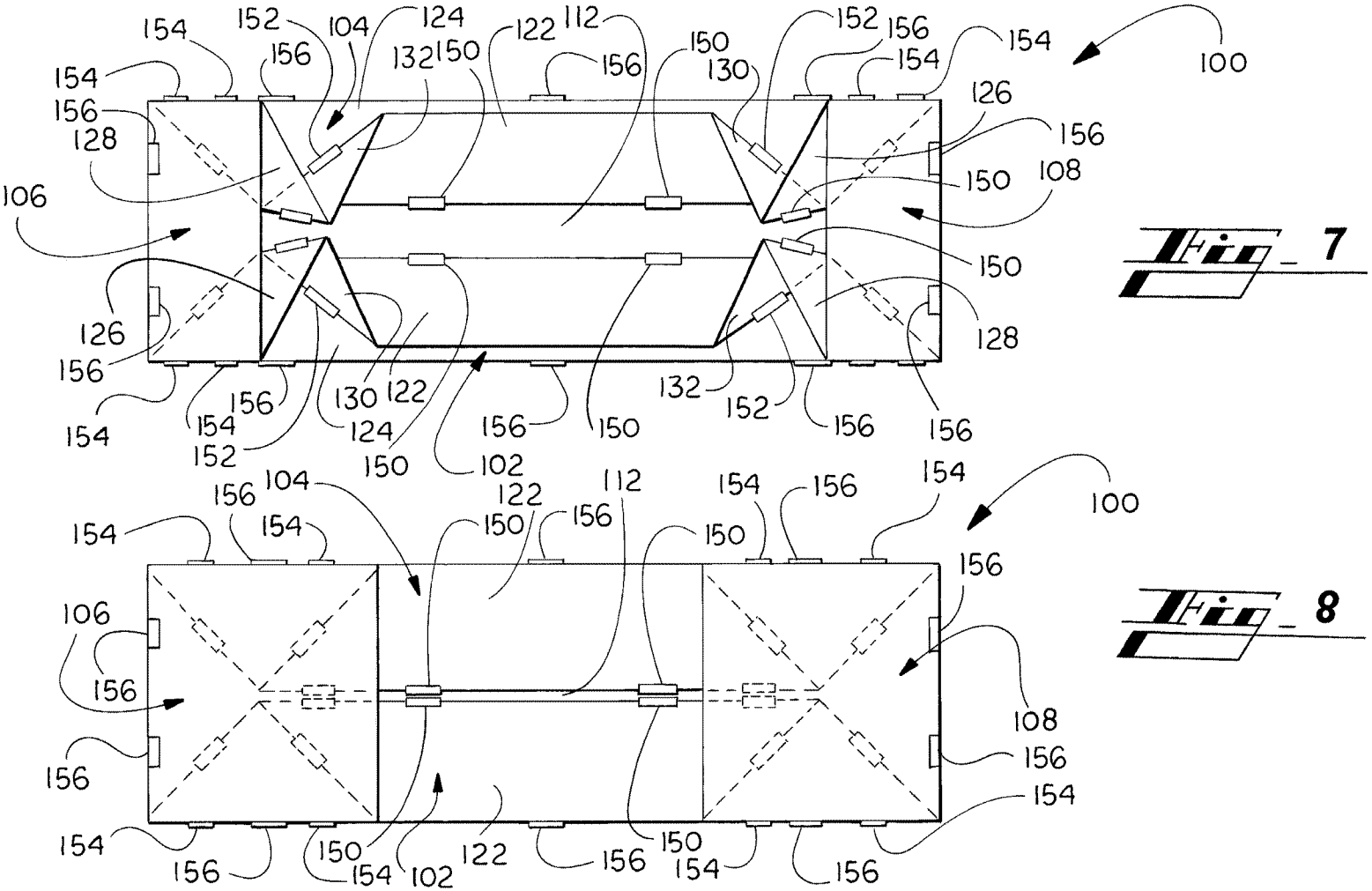
FIG. 7 illustrates a top view of the collapsible container of FIG. 1 with the roof and guides removed and the doors not defined in the end wall, the container in a partially collapsed state and with portions of the container otherwise obscured by the end walls shown in dashed line.
FIG. 8 illustrates a top view of the configuration and parts of the collapsible container shown in FIG. 7 and the container in a fully collapsed state and with portions of the container otherwise obscured by the end walls shown in dashed line.

As shown in FIG. 8, when the container 100 is completely collapsed, the first end wall 106 is folded down on the first side trapezoidal panel 126 of the first side wall 102, and the second side trapezoidal panel 128 of the second side wall 104. Under the first side trapezoidal panel 126 in turn is the first triangular panel 130 immediately under which is a section of the top center trapezoidal panel 122 equal in area to the area of the first triangular panel 130, and a portion of the bottom center trapezoidal panel 124. Likewise, the second end wall 108 is folded down onto the second side trapezoidal panel 128 under which is disposed the second triangular panel 132 and a section of the top center trapezoidal panel 122 equal in area to the area of the second triangular panel 132, and under all of these panels and panel portions is a portion of the bottom center trapezoidal panel 124.

As shown in FIG. 1, the first end wall 106 can have formed therein an opening that can be closed by a first door 114 and a second door 116 both which are mounted on hinges to the first end wall 106. The first and second doors 114 and 116 can be closed to close the container 100 or opened to allow access to the interior of the container 100.

Figure 9:
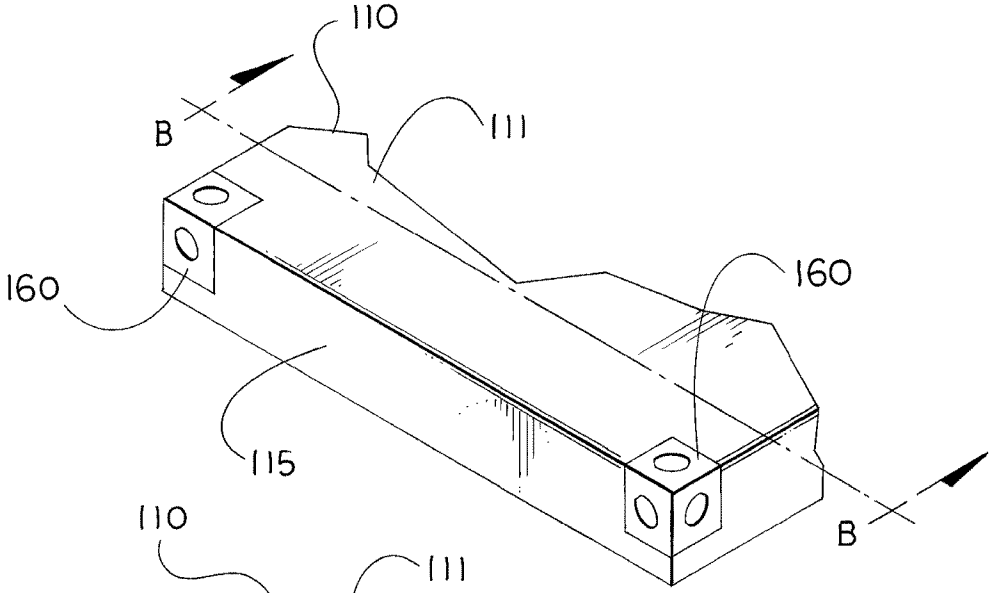
FIG. 9 illustrates a perspective view of a portion of the roof of the collapsible container of FIG. 1 removed from the rest of the container.
Figure 10:
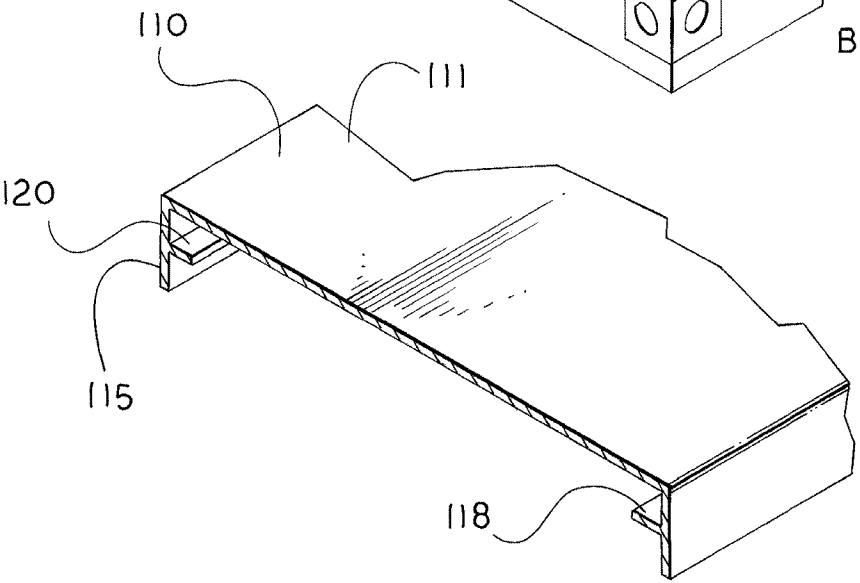
FIG. 10 illustrates a perspective view of a cross-section of a portion of the roof shown in FIG. 9 taken along line B-B.

As shown in FIGS. 9 and 10, the roof 110 includes a top panel 111 and a skirt 115 that extends downward from the edge of the top panel 111 and extends around the perimeter thereof. The roof 110 includes a first rail 118 disposed adjacent the first side wall 102 and a second rail 120 disposed adjacent the second side wall 104. The first and second rails 118 and 120 can extend along all or a substantial portion of the length of the roof 110 and are configured to receive at least a portion of one of the rollers 266 that form part of one of the first, second, third or fourth guides 176, 174, 178 or 180 that are mounted to the first and the second end walls 106 and 108, respectively. More specifically, the first rail 118 is aligned to cooperate with the first guide 176 on the first end wall 106 and the third guide 178 on the second end wall 108, while the second rail 120 is configured to cooperate with the second guide 174 on the first end wall 106 and the second guide 180 on the second end wall 108. The first and the second rails 118 and 120 can be aligned at the bottom of the major side sections of the skirt 115 or along intermediate portions thereof, as shown in FIG. 10. More particularly, the rollers 266 can be disposed between the respective first and second rails 118 and 120 and the top panel 111 of the roof 110 and can roll back and forth along a portion of the length of the respective first or second rail 118 or 120 as the container 100 is collapsed or extended.

As shown in FIG. 4, the first end wall 106 and the second end wall 108 each include two of four guides 174, 176, 178 and 180 that engage a portion of the roof 110 so as to assist in configuring the relative orientation of the roof 110 with both the first and the second end walls 106 and 108 both when the container 100 is erect and when the container 100 is being collapsed.

More particularly as shown in FIG. 4, the first end wall 106 includes a first guide 176 and a second guide 174, and the second end wall 108 includes a third guide 178 and a fourth guide 180. The first guide 176 is mounted to the inner face of the first end wall 106 and is aligned in the upper left hand corner thereof as viewed from the interior side of the first end wall 106. As shown in FIGS. 11-14, each of the guides 176, 174, 178 and 180, as illustrated by the second guide 174, includes a bracket 262 by which the respective guide is mounted to the respective first or second end wall 106 or 108. A spring 260 is attached to the bracket 262 and is operably connected to an arm 264 that extends inwardly from the respective end wall. The spring 260 cooperates with the arm 264 so as to allow the arm 264 to not only pivot about the bracket 262, but also move away therefrom and rotate thereabout. The arm 264 can pivot about the bracket 262 or, when sufficient force is applied thereto, such as when the container 100 is collapsing, the arm 264 can move in any direction due to the movable connection of the spring 260 thereto. A roller 266 is axially mounted on a pin that projects from the arm 264 toward the second side wall 104. The roller 266 can rotate about the pin, which can be aligned generally parallel to the major plane of the first end wall 106. The roller 266 is disposed in a track formed by the rail 120 and the top panel 111 of the roof 110. The roller 266 can move along the rail 120.

Figure 13:
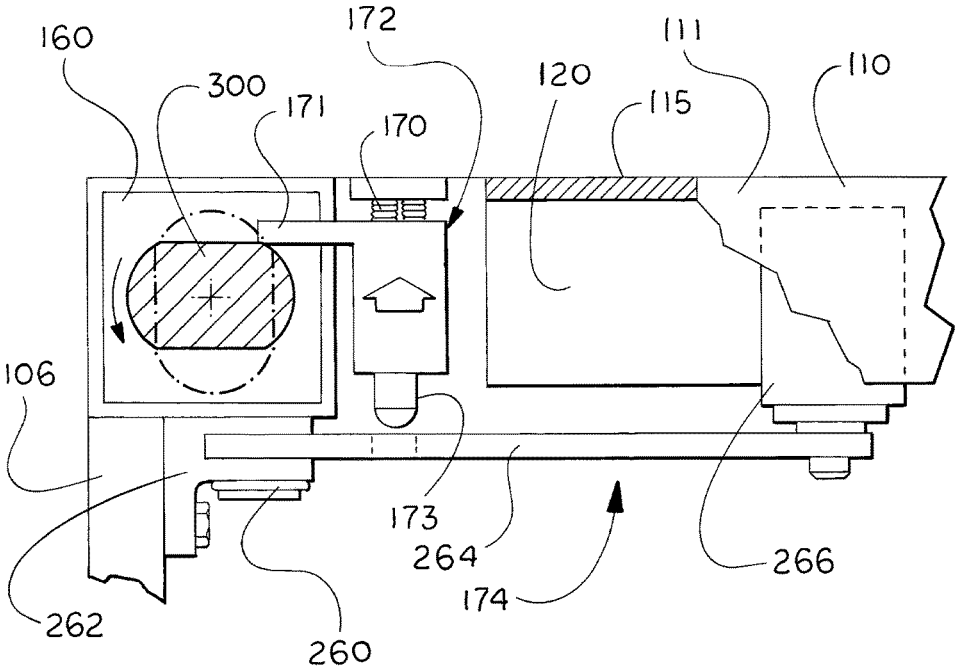
FIG. 13 illustrates the cutaway top view of the interior portion of the top corner of the collapsible container shown in FIG. 12 with a twistlock engaging the retainer and placing it in a cocked position.

The arm 264 has an opening formed therein that is configured to receive a guide catch 173 that can take the form of a pin, as shown in FIG. 13. When the container 100 is in an upright, erect alignment the guide catch 173 is disposed in the opening of the arm 264 and thereby prevents the arm 264 from moving. The guide catch 173 forms part of a retainer 172 that is configured to keep the guide 174 secured when the container 100 is erect. The retainer 172 also comprises a retainer arm 168 to which the guide catch 173 is attached. The retainer 172 is mounted to the skirt 115 of the roof 110 and includes a pair of springs 170 that cooperate with the retainer arm 168 to allow the retainer 172 move in two directions along an axis generally parallel to the first end wall 106 while biasing the retainer 172 inward and away from the outer surface of the skirt 115. The retainer 172 also includes a twistlock pin 171 that extends from the retainer arm 168.

Figure 12:
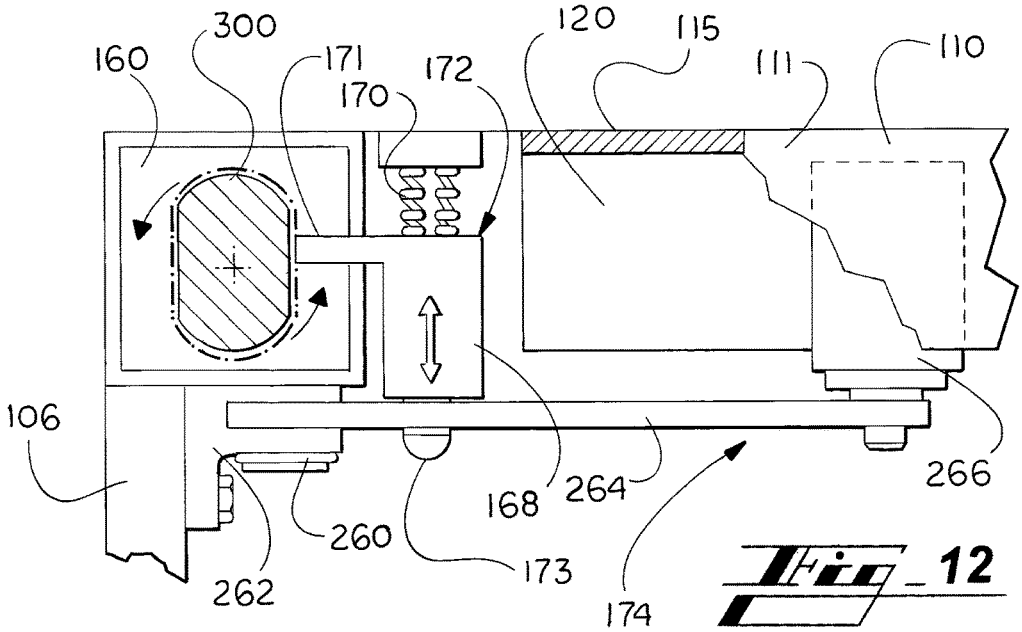
FIG. 12 illustrates a cutaway top view of the interior portion of the top corner of the collapsible container shown in FIG. 11.
Figure 11:
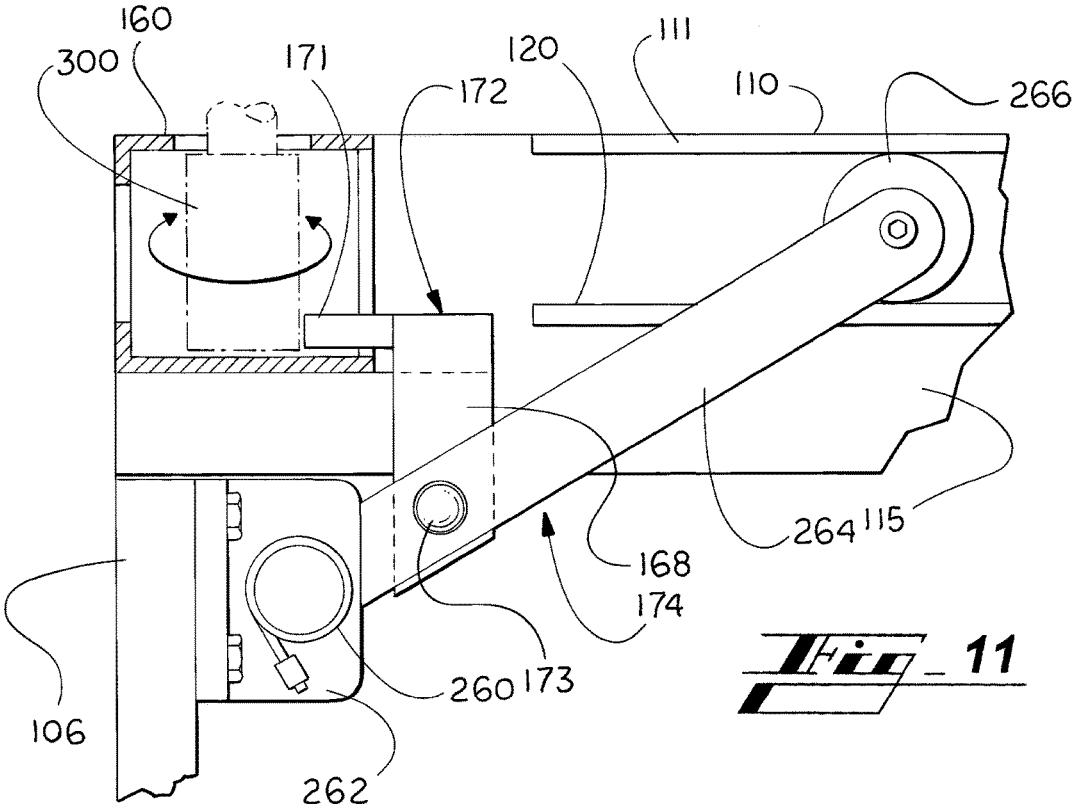
FIG. 11 is a side elevation view of a portion of the interior of a top corner of the collapsible container of FIG. 1 with portions thereof shown in dashed line.

As shown in FIG. 1, the roof 110 includes adjacent each corner thereof a twistlock receiver 160 that can include one or more openings formed therein to allow insertion into the twistlock receiver 160 of either a conventional twistlock that can be used either to move or secure in place the container 100, or a modified twistlock 300 that can be used either to erect or collapse the container 100. As shown in FIGS. 11-13, each of the twistlock receivers 160 include at least a portion of the twistlock pin 171 that is movably mounted in the container 100. Each retainer 172 is configured to engage and to disengage one of the guides 174, 176, 178 or 180. When the container 100 is erect, a guide 174 is aligned adjacent a corner of the container 100 and is engaged by the guide catch 173 when the retainer 172 is in the starting position biased toward the interior of the container 100. The engagement of the guide 174 by the guide catch 173 prevents the guide 174 from moving toward the midline of the container 100 along the first rail 118, and thereby keeps the container 100 erect. When a modified twistlock 300 is inserted into the twistlock receiver 160 and twisted, the modified twistlock 300 engages the twistlock pin 171 and pushes the twistlock pin 171 outward toward the outer wall of the skirt 115 to a cocked position. The entire retainer 172 thereby moves, thereby causing the guide catch 173 to clear the opening in the arm 264 of the second guide 174 and disengage therefrom. The second guide 174 is thereby free to move along the second rail 120 toward the midline of the container 100 so as to allow the container 100 to collapse. The springs 170 compress when the retainer 172 moves to the cocked position. When the modified twistlock 300 disengages the twistlock pin 171, the spring 170 pushes the retainer 172 back to the starting position. The present disclosure also encompasses other configurations of a retainer assembly whereby the guides can be engaged to retain the container 100 in an erect configuration and disengaged to allow for the container 100 to be collapsed.

In one configuration, the twistlock pin 171 is configured to be engaged by a modified twistlock 300 that is designed to move the twistlock pin 171 back and forth between a starting position and a cocked position, so as to allow the container 100 to be collapsed or erected as appropriate. The twistlock pin 171 is aligned and configured so that a conventional twistlock, used either to move or secure in place the container 100, does not engage the twistlock pin 171 and start either the process of collapsing or erecting the container 100. The modified twistlock 300 can include a portion formed on the head thereof that would extend beyond the normal clearance of a twistlock head. This twistlock head would thereby engage the twistlock pin 171 when rotated, whereas a conventional twistlock head would otherwise clear the twistlock pin 171 when rotated.

In an alternative arrangement, a retainer can be provided that includes an arm pivotally mounted adjacent a twistlock receiver in the interior of the container. The arm includes a guide catch that can be aligned between the guide and the medial portion of the rail so as to maintain the guide at the proximal end of the rail and the container in an upright erect configuration. A modified twistlock can be inserted into the twistlock receiver and rotated so as to engage the arm and cause the arm to pivot upward, thereby causing the guide catch to move above and clear the guide. The guide is then free to move along the rail so as to allow the container to collapse. These and other configurations of a retainer are contemplated and encompassed by the present disclosure.

Figure 14:
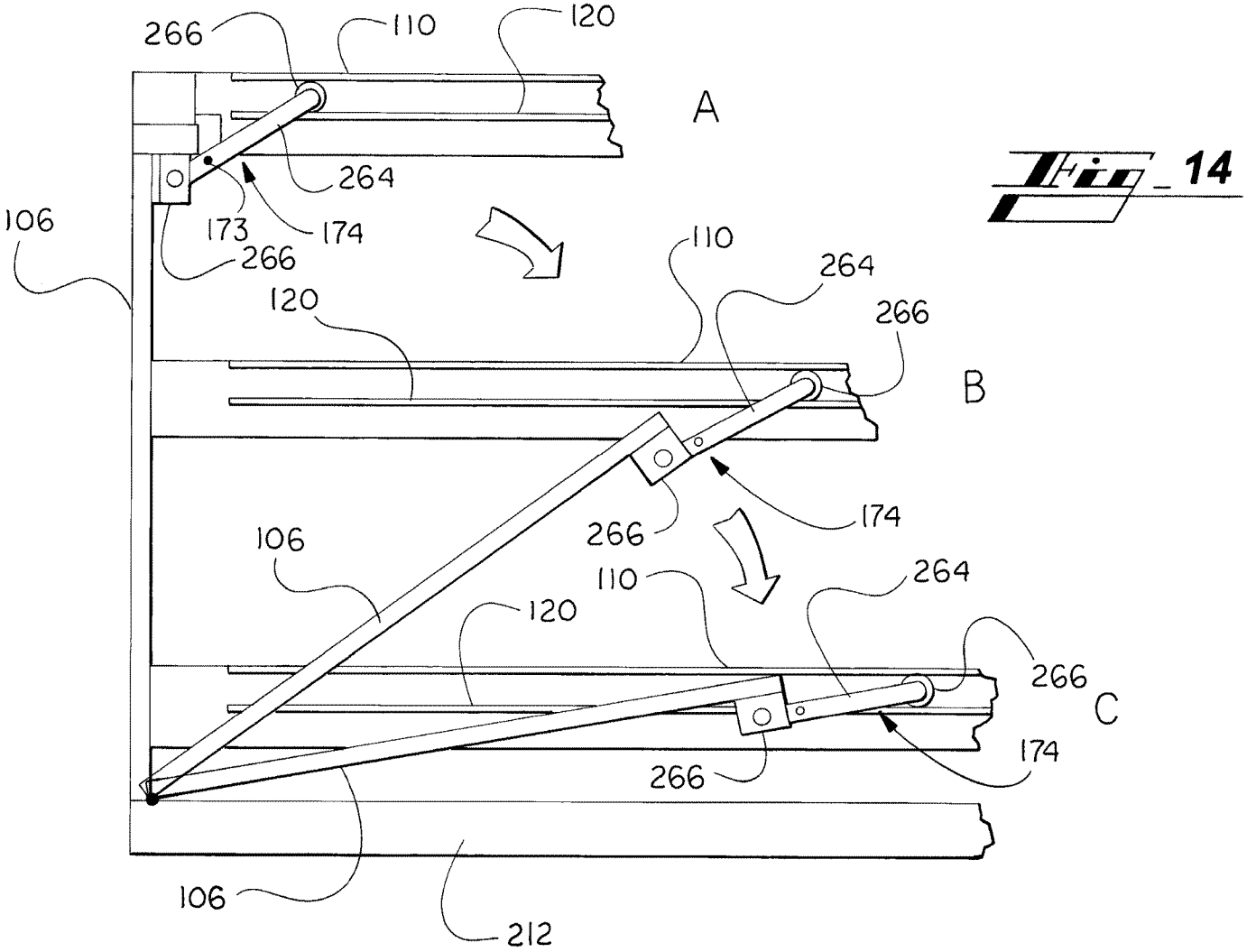
FIG. 14 illustrates a side elevation view of portions of parts of the collapsible container of FIG. 1, including a portion of the roof, a guide, the first end wall and a portion of the base and the side walls removed, shown in various stages fully erect in view A, partially collapsed in view B and completely collapsed in view C.

When an erect container 100 is to be collapsed, a user employs a forklift or stacker that includes four twistlocks that can be inserted simultaneously into the twistlock receivers 160 disposed on each of the four corners of the roof 110. Each modified twistlock 300 engages each twistlock pin 171 disposed in the respective twistlock receiver 160 and moves it from a starting position to a cocked position, whereby the guide catch 173 is disengaged from the respective guide 174, 176, 178 or 180. As shown in FIG. 14, each guide, as illustrated by the second guide 174, can then move inward toward the midline of the container 100, thereby allowing the first end wall 106 to fold down into the container 100. The first and the second side walls 102 and 104, each connected by hinges to the first and the second end walls 106 and 108 thereby collapse with the panels folding down on each other as described hereinabove. The roof 110 moves downward toward the base 112 as the walls fold down as the twistlocks 300 on the stacker lowers the container 100 with the aid of gravity. The walls will be sandwiched between the base 112 and the roof 110 when the container 100 is completely collapsed, thereby greatly reducing the volume that the container 100 displaces in its collapsed arrangement. A collapsed container 100 can be more easily moved and stored, with a greater number of containers being placed in a given space than would be possible if the containers were erect.

In one example of a collapsible container taking the form of an intermodal shipping container, both of the first and the second side walls 102 and 104 are about 12.2 m in length and about 2.6 m in height. The first and the second end walls 106 and 108 are about 2.44 m in width and about 2.6 m in height, and the roof 110 and the base 112 are both about 2.44 m in width and about 12.2 m in length. The first and second side walls 102 and 104 and the first and second end walls 106 and 108 are formed of corrugated steel. It is to be understood that the present disclosure encompasses collapsible containers that vary both in size and materials of construction.

It will be apparent to those skilled in the art that various modifications and variations can be made to the containers, mechanisms and components set forth herein and such modifications and variations are contemplated and encompassed by the present disclosure.

What is claimed is:

1. A collapsible container comprising:

a base;

a first side wall movably connected to the base, wherein the first side wall comprises a bottom center trapezoidal panel movably connected to the base, a top center trapezoidal panel movably connected to the bottom center trapezoidal panel, a first triangular panel movably connected to the top center trapezoidal panel, a second triangular panel movably connected to the top center trapezoidal panel, a first side trapezoidal panel movably connected to the bottom center trapezoidal panel and the first triangular panel, and a second side trapezoidal panel movably connected to the bottom center trapezoidal panel and the second triangular panel, wherein the first triangular panel comprises a first triangular panel top side, wherein the first side trapezoidal panel comprises a top side, and wherein the top side of the first side trapezoidal panel is aligned collinear with the first triangular panel top side in an erect alignment of the first side wall;

a second side wall movably connected to the base and opposing the first side wall;

a first end wall movably connected to the base, the first side wall and the second side wall; and, a second end wall movably connected to the base, the first side wall and the second side wall, and wherein the second end wall is opposed to the first end wall.

2. The collapsible container of claim 1, further comprising a roof aligned over the base, wherein the roof movably cooperates with the first end wall, the second end wall, the first side wall and the second side wall.

3. The collapsible container of claim 1, wherein the second side wall comprises a second bottom center trapezoidal panel movably connected to the base, a second top center trapezoidal panel movably connected to the second bottom center trapezoidal panel, a third triangular panel movably connected to the second top center trapezoidal panel, a fourth triangular panel movably connected to the second top center trapezoidal panel, a third side trapezoidal panel movably connected to the second bottom center trapezoidal panel and the third triangular panel, and a fourth side trapezoidal panel movably connected to the second bottom center trapezoidal panel and the fourth triangular panel.

4. A collapsible container comprising:

a base;

a first side wall movably connected to the base, wherein the first side wall comprises a bottom center trapezoidal panel movably connected to the base, a top center trapezoidal panel movably connected to the bottom center trapezoidal panel, a first triangular panel movably connected to the top center trapezoidal panel, a second triangular panel movably connected to the top center trapezoidal panel, a first side trapezoidal panel movably connected to the bottom center trapezoidal panel and the first triangular panel, and a second side trapezoidal panel movably connected to the bottom center trapezoidal panel and the second triangular panel;

a second side wall movably connected to the base and opposing the first side wall;

a first end wall movably connected to the base, the first side wall and the second side wall, wherein the first end wall comprises a first end wall top edge; and, a second end wall movably connected to the base, the first side wall and the second side wall, wherein the second end wall is opposed to the first end wall, and wherein the second end wall comprises a second end wall top edge;

a roof aligned over the base, wherein the roof movably cooperates with the first end wall, the second end wall, the first side wall and the second side wall, and wherein the roof comprises a rail;

a first guide mounted to the first end wall; and, a second guide mounted to the second end wall, and wherein the first guide and the second guide movably cooperate with the rail.

5. A collapsible container comprising:

a base;

a first side wall movably connected to the base, wherein the first side wall comprises a bottom center trapezoidal panel movably connected to the base, a top center trapezoidal panel movably connected to the bottom center trapezoidal panel, a first triangular panel movably connected to the top center trapezoidal panel, a second triangular panel movably connected to the top center trapezoidal panel, a first side trapezoidal panel movably connected to the bottom center trapezoidal panel and the first triangular panel, and a second side trapezoidal panel movably connected to the bottom center trapezoidal panel and the second triangular panel, wherein the bottom center trapezoidal panel comprises a bottom center trapezoidal panel left side, wherein the first triangular panel comprises a first triangular panel left side, wherein the first side trapezoidal panel comprises a base side and a right side, wherein the first triangular panel left side of the first triangular panel is aligned adjacent to the right side of the first side trapezoidal panel and the bottom center trapezoidal panel left side is aligned adjacent to the base side of the first side trapezoidal panel in an erect alignment of the first side wall;

a second side wall movably connected to the base and opposing the first side wall;

a first end wall movably connected to the base, the first side wall and the second side wall; and, a second end wall movably connected to the base, the first side wall and the second side wall, and wherein the second end wall is opposed to the first end wall; and, wherein the first side wall comprises a plurality of external hinges mounted thereto.

6. The collapsible container of claim 5, wherein the first side wall further comprises a plurality of internal hinges mounted thereto.

7. The collapsible container of claim 5, wherein the bottom center trapezoidal panel is movably connected to the base by an external hinge, and wherein the bottom center trapezoidal panel is movably connected to the top center trapezoidal panel by an internal hinge.

8. The collapsible container of claim 5, wherein the first side trapezoidal panel is movably connected to the bottom center trapezoidal panel by a first internal hinge, and wherein the second side trapezoidal panel is movably connected to the bottom center trapezoidal panel by a second internal hinge.

9. A collapsible container comprising:

a base;

a first side wall movably connected to the base, wherein the first side wall comprises a bottom center trapezoidal panel movably connected to the base, a top center trapezoidal panel movably connected to the bottom center trapezoidal panel, a first triangular panel movably connected to the top center trapezoidal panel, a second triangular panel movably connected to the top center trapezoidal panel, a first side trapezoidal panel movably connected to the bottom center trapezoidal panel and the first triangular panel, and a second side trapezoidal panel movably connected to the bottom center trapezoidal panel and the second triangular, wherein the first triangular panel is movably connected to the top center trapezoidal panel by an external hinge, and wherein the first triangular panel is movably connected to the first side trapezoidal panel by an internal hinge;

a second side wall movably connected to the base and opposing the first side wall;

a first end wall movably connected to the base, the first side wall and the second side wall; and, a second end wall movably connected to the base, the first side wall and the second side wall, and wherein the second end wall is opposed to the first end wall; and, wherein the first side wall comprises a plurality of external hinges mounted thereto.

10. The collapsible container of claim 9, wherein the second triangular panel is movably connected to the top center trapezoidal panel by a second external hinge, and wherein the second triangular panel is movably connected to the second side trapezoidal panel by a second internal hinge.

11. A collapsible container comprising:

a base;

a first side wall movably connected to the base, wherein the first side wall comprises a bottom center trapezoidal panel movably connected to the base, a top center trapezoidal panel movably connected to the bottom center trapezoidal panel, a first triangular panel movably connected to the top center trapezoidal panel, a second triangular panel movably connected to the top center trapezoidal panel, a first side trapezoidal panel movably connected to the bottom center trapezoidal panel and the first triangular panel, and a second side trapezoidal panel movably connected to the bottom center trapezoidal panel and the second triangular panel;

a second side wall movably connected to the base and opposing the first side wall;

a first end wall movably connected to the base, the first side wall and the second side wall; and, a second end wall movably connected to the base, the first side wall and the second side wall, and wherein the second end wall is opposed to the first end wall; and, a roof aligned over the base, wherein the roof movably cooperates with the first end wall, the second end wall, the first side wall and the second side wall, wherein the roof comprises four corners, and wherein each of the four corners comprises a twistlock receiver disposed thereon, and wherein each twistlock receiver comprises a chamber, wherein at least a portion of a retainer is movably disposed within the chamber, and wherein the retainer movably cooperates with a twistlock inserted into the twistlock receiver.

12. The collapsible container of claim 11, wherein the retainer comprises a guide catch, wherein the guide catch movably engages a guide aligned adjacent a corner of the roof.

13. The collapsible container of claim 12, wherein the guide catch movably disengages the guide to collapse the container.

14. A collapsible container comprising:

a base;

a first side wall movably connected to the base, wherein the first side wall comprises a bottom center trapezoidal panel movably connected to the base, a top center trapezoidal panel movably connected to the bottom center trapezoidal panel, a first triangular panel movably connected to the top center trapezoidal panel, a second triangular panel movably connected to the top center trapezoidal panel, a first side trapezoidal panel movably connected to the bottom center trapezoidal panel and the first triangular panel, and a second side trapezoidal panel movably connected to the bottom center trapezoidal panel and the second triangular panel;

a second side wall movably connected to the base and opposing the first side wall;

a first end wall movably connected to the base, the first side wall and the second side wall, wherein the first end wall is folded down on the first side trapezoidal panel in a collapsed alignment of the first end wall; and, a second end wall movably connected to the base, the first side wall and the second side wall, and wherein the second end wall is opposed to the first end wall; and, a door hingedly mounted to the first end wall.

15. A collapsible intermodal shipping container comprising:

a base;

a first side wall movably connected to the base, wherein the first side wall comprises a first bottom center trapezoidal panel movably connected to the base, a first top center trapezoidal panel movably connected to the first bottom center trapezoidal panel, a first triangular panel movably connected to the first top center trapezoidal panel, a second triangular panel movably connected to the first top center trapezoidal panel, a first side trapezoidal panel movably connected to the first bottom center trapezoidal panel and the first triangular panel, and a second side trapezoidal panel movably connected to the first bottom center trapezoidal panel and the second triangular panel;

a second side wall movably connected to the base and opposing the first side wall, wherein the second side wall comprises a second bottom center trapezoidal panel movably connected to the base, a second top center trapezoidal panel movably connected to the second bottom center trapezoidal panel, a third triangular panel movably connected to the second top center trapezoidal panel, a fourth triangular panel movably connected to the second top center trapezoidal panel, a third side trapezoidal panel movably connected to the second bottom center trapezoidal panel and the third triangular panel, and a fourth side trapezoidal panel movably connected to the second bottom center trapezoidal panel and the fourth triangular panel;

a first end wall movably connected to the base, the first side wall and the second side wall;

a second end wall movably connected to the base, the first side wall and the second side wall, wherein the second side wall is opposed to the first side wall;

a roof aligned over the base, wherein the roof movably cooperates with the first end wall, the second end wall, the first side wall and the second side wall, and wherein the roof comprises a twistlock receiver; and, a door mounted to the first end wall.

16. The collapsible intermodal shipping container of claim 15, wherein the roof comprises a rail, and wherein the first end wall further comprises a first guide and the second end wall further comprises a second guide, wherein the first guide and the second guide movably cooperate with the rail, wherein the roof further comprises a second rail, and wherein the first end wall further comprises a third guide, and the second end wall further comprises a fourth guide, and wherein the third guide and the fourth guide movably cooperate with the second rail.

17. The collapsible intermodal shipping container of claim 15, wherein the twistlock receiver comprises a retainer, whereby the retainer movably cooperates with a twistlock inserted into the twistlock receiver, and wherein the retainer comprises a guide catch, wherein the guide catch movably engages at least one of the first guide, the second guide, the third guide and the fourth guide, and whereby the guide catch movably disengages the at least one of the first guide, the second guide, the third guide and the fourth guide to collapse the container.

18. A collapsible intermodal shipping container comprising:

a base;

a first side wall movably connected to the base, wherein the first side wall comprises a first bottom center trapezoidal panel movably connected to the base by a first external hinge, a first top center trapezoidal panel movably connected to the first bottom center trapezoidal panel by a first internal hinge, a first triangular panel movably connected to the first top center trapezoidal panel by a second external hinge, a second triangular panel movably connected to the first top center trapezoidal panel by a third external hinge, a first side trapezoidal panel movably connected to the first bottom center trapezoidal panel by a second internal hinge, wherein the first side trapezoidal panel is movably connected to the first triangular panel by a third internal hinge, and a second side trapezoidal panel movably connected to the first bottom center trapezoidal panel by a fourth internal hinge, and wherein the second side trapezoidal panel is movably connected to the second triangular panel by a fifth internal hinge;

a second side wall movably connected to the base and opposing the first side wall, wherein the second side wall comprises a second bottom center trapezoidal panel movably connected to the base by a fourth external hinge, a second top center trapezoidal panel movably connected to the second bottom center trapezoidal panel by a sixth internal hinge, a third triangular panel movably connected to the second top center trapezoidal panel by a fifth external hinge, a fourth triangular panel movably connected to the second top center trapezoidal panel by a sixth external hinge, a third side trapezoidal panel movably connected to the second bottom center trapezoidal panel by a seventh internal hinge, wherein the third side trapezoidal panel is movably connected to the third triangular panel by an eighth internal hinge, and a fourth side trapezoidal panel movably connected to the second bottom center trapezoidal panel by a ninth internal hinge, and wherein the fourth side trapezoidal panel is movably connected to the fourth triangular panel by a tenth internal hinge;

a first end wall movably connected to the base by a seventh external hinge, wherein the first end wall is movably connected to the first side wall by an eighth external hinge, and wherein the first end wall is movably connected to the second side wall by a ninth external hinge;

a second end wall movably connected to the base by a tenth external hinge, wherein the second end wall is movably connected to the first side wall by an eleventh external hinge, wherein the second end wall is movably connected to the second side wall by a twelfth external hinge, and wherein the second side wall is opposed to the first side wall;

a roof aligned over the base, wherein the roof movably cooperates with the first end wall, the second end wall, the first side wall and the second side wall, wherein the roof comprises a rail, and wherein the first end wall further comprises a first guide and the second end wall further comprises a second guide, wherein the first guide and the second guide movably cooperate with the rail;

a twistlock receiver mounted to the roof, wherein the twistlock receiver comprises a retainer, whereby the retainer movably cooperates with a twistlock inserted into the twistlock receiver, and wherein the retainer comprises a guide catch, wherein the guide catch movably engages at least one of the first guide and the second guide, and whereby the guide catch movably disengages the at least one of the first guide and the second guide to collapse the container; and, a door hingedly mounted to one of the first end wall and the second end wall.

* * * * *